US008397801B2

(12) United States Patent
Wood et al.

(10) Patent No.: US 8,397,801 B2
(45) **Date of Patent: *Mar. 19, 2013**

(54) SYSTEM, METHOD AND APPARATUS FOR CONDUCTING EARTH BOREHOLE OPERATIONS

(75) Inventors: Thomas D. Wood, Calgary (CA); Richard Havinga, Okotoks (CA)

(73) Assignee: Xtreme Drilling and Coil Services Corp., Calgary, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/315,938

(22) Filed: Dec. 9, 2011

(65) Prior Publication Data

US 2012/0080180 A1 Apr. 5, 2012

Related U.S. Application Data

(63) Continuation of application No. 12/910,921, filed on Oct. 25, 2010, now Pat. No. 8,074,710, which is a continuation of application No. 11/300,842, filed on Dec. 15, 2005, now Pat. No. 7,810,554, which is a continuation-in-part of application No. 11/198,475, filed on Aug. 5, 2005, now abandoned, and a continuation-in-part of application No. 11/155,056, filed on Jun. 17, 2005, now Pat. No. 7,516,798, and a continuation-in-part of application No. 11/165,931, filed on Jun. 24, 2005, now Pat. No. 7,182,140.

(60) Provisional application No. 60/737,611, filed on Nov. 17, 2005.

(51) Int. Cl.
*E21B 19/22* (2006.01)

(52) U.S. Cl. ..... 166/77.2; 166/77.51; 166/384; 175/162

(58) Field of Classification Search ..... 166/377, 166/380, 384, 77.2, 77.51, 85.5, 77.1
See application file for complete search history.

(56) References Cited

U.S. PATENT DOCUMENTS

| | | | | |
|---|---|---|---|---|
| 5,839,514 | A * | 11/1998 | Gipson | 166/384 |
| 6,408,955 | B2 * | 6/2002 | Gipson | 175/57 |
| 7,810,554 | B2 * | 10/2010 | Wood et al. | 166/77.2 |
| 7,810,556 | B2 * | 10/2010 | Havinga | 166/77.3 |
| 8,074,710 | B2 * | 12/2011 | Wood et al. | 166/77.2 |
| 2003/0098150 | A1 * | 5/2003 | Andreychuk | 166/77.2 |
| 2004/0206551 | A1 * | 10/2004 | Carriere et al. | 175/203 |
| 2006/0207767 | A1 * | 9/2006 | Andreychuk | 166/379 |
| 2007/0125549 | A1 * | 6/2007 | Wood | 166/380 |
| 2007/0125551 | A1 * | 6/2007 | Havinga | 166/384 |

* cited by examiner

*Primary Examiner* — Daniel P Stephenson
*Assistant Examiner* — Robert E Fuller
(74) *Attorney, Agent, or Firm* — Bushman & Associates, P.C.

(57) ABSTRACT

A system for conducting earth borehole operations comprising a CT carrier, a reel of CT rotatably mounted on the CT carrier, a mast carrier, separate from the CT carrier, a mast mounted on the mast carrier and movable between a lowered position for transport and a position transverse to the horizontal, a top drive carried by the mast, the top drive being longitudinally movable along the mast and a CT injector on the mast carrier.

28 Claims, 10 Drawing Sheets

SYSTEM, METHOD AND APPARATUS FOR CONDUCTING EARTH BOREHOLE OPERATIONS

CROSS REFERENCE TO RELATED APPLICATIONS

This application is a continuation of U.S. application Ser, No. 12/910,921, filed Oct. 25, 2010, now issued as U.S. Pat. No. 8,074,710, which is a continuation of U.S. application Ser. No. 11/300,842 filed Dec. 15, 2005, now issued as U.S. Pat. No. 7,810,554, which is a continuation-in-part of U.S. patent application Ser. No. 11/198,475 filed Aug. 5, 2005 for APPARATUS AND METHOD FOR PERFORMING EARTH BOREHOLE OPERATIONS, now abandoned, U.S. patent application Ser. No. 11/155,056 filed Jun. 17, 2005 for COILED TUBING TRANSPORT SYSTEM AND METHOD, now issued as U.S. Pat. No. 7,516,798, and U.S. patent application Ser. No. 11/165,931 filed Jun. 24, 2005 for COILED TUBING/TOP DRIVE RIG AND METHOD, now issued as U.S. Pat. No. 7,182,140, which claim priority to U.S. Provisional Application Ser. No. 60/737,611 filed Nov. 17, 2005, now expired, each of which is incorporated herein in their entirety for all purposes.

BACKGROUND OF THE INVENTION

1. Field of the Invention

The present invention relates to a system, method and apparatus for performing earth borehole operations.

2. Description of Prior Art

The use of coiled tubing (CT) technology in oil and gas drilling and servicing has become more and more common in the last few years. In CT technology, a continuous pipe wound on a spool is straightened and injected into a well using a CT injector. CT technology can be used for both drilling and servicing, e.g., workovers.

The advantages offered by the use of CT technology, including economy of time and cost are well known. As compared with jointed-pipe technology wherein typically 30-45 foot straight sections of pipe are threadedly connected one section at a time while drilling the wellbore, CT technology allows the continuous deployment of pipe while drilling the well, significantly reducing the frequency with which such drilling must be suspended to allow additional sections of pipe to be connected. This results in less connection time, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a surface hole using jointed-pipe, cement casing into the surface hole, and then switch over to CT drilling. Additionally, when difficult formations such as gravel are encountered down-hole, it may be necessary to switch from CT drilling to jointed-pipe drilling until drilling through the formation is complete, and then switch back to CT drilling to continue drilling the well. Similarly, when it is necessary to perform drill stem testing to assess conditions downhole, it may again be necessary to switch from CT drilling to jointed-pipe drilling and then back again. Finally, a switch back to jointed pipe operations is necessary to run casing into the drilled well. In short, in CT drilling operations it is generally necessary for customers and crew to switch back and forth between a CT drilling rig and a jointed-pipe conventional drilling rig, a process which results in significant down-time as one rig is moved out of the way, and the other rig put in place.

Another disadvantage of CT drilling is the time consuming process of assembling a (bottom-hole-assembly (BHA)—the components at the end of the CT for drilling, testing, well servicing, etc.), and connecting the BHA to the end of the CT. Presently, this step is performed manually through the use of rotary tables and make-up/breakout equipment. In some instances, top drives are used but the CT injector and the top drive must be moved out of each others way, i.e., they cannot both be in line with the borehole. Not only does this process result in costly downtime, but it can also present safety hazards to the workers as they are required to manipulate heavy components manually.

To address the problems above associated with the use of CT technology and provide for selective and rapid switching from the use of a CT injector to a top drive operation, certain so-called "universal" or "hybrid" rigs have been developed. Typical examples of the universal rigs, i.e., a rig which utilizes a single mast to perform both top drive and CT operations, the top drive and the CT injector being generally at all times operatively connected to the mast, are shown in United States Patent Publication 2004/0206551; and U.S. Pat. Nos. 6,003,598, and 6,609,565. Thus, in U.S. Publication 2004/0206551 there is disclosed a rig adapted to perform earth borehole operations using both CT and/or jointed-pipes, the CT injector and a top drive being mounted on the same mast, the CT injector being selectively moveable between a first position wherein the CT injector is in line with the mast of the rig and hence the earth borehole and a second position wherein the CT injector is out of line with the mast and hence the earth borehole.

In all of the systems disclosed in the aforementioned patents, publications and the cross-referenced related applications, the reel of CT and the CT injector are on or are carried by the same carrier. Heretofore in CT operations particularly drilling, well depth has been limited to about 2200 meters because of governmental regulations regarding the weight and/or height of loads moving on highways. A CT injector can weigh from 20,000 to 40,000 lbs depending upon its size. As to the CT itself, 2200 meters of 3½" W CT, including the reel upon which it is wound can weigh from 60,000 to 80,000 lbs. Thus, because of governmental regulations regarding weight that can be transported on highways, reels of 3½" CT exceeding about 2200 meters cannot be transported on most highways since the combined weight of the CT and the CT injector would exceed the weight limitations. Clearly it is possible to transport greater lengths of smaller diameter, e.g., 2⅞" CT. However, particularly in using CT to conduct drilling operations at depths of about 2200 meters, the hydraulics of fluid flow; e.g., flow of drilling mud, dictate that the CT be 3½" or greater in diameter.

In prior art CT systems wherein a reel or spool of CT is mounted on a carrier, the spool is positioned on the carrier such that the core on which the CT can be wound does not extend for the maximum width of the carrier. This is because the drive assembly used to rotate the spool is on the side of the spool meaning that the drive assembly takes up some of the lateral spacing between the opposed sides of the CT carrier. Since this reduces the overall length of the spool and hence the length of the winding core, less CT can be wound upon the spool in these prior art systems.

SUMMARY OF THE INVENTION

In one aspect the present invention provides a system for use in conducting earth borehole operations, the system comprising a CT carrier and a reel of CT rotatably mounted thereon. The system further comprises a separate, mast carrier having a mast which is movable from a lowered, e.g., horizontal position, for transportation to a position transverse to the horizontal, e.g., generally vertical. A top drive is carried by the mast for longitudinal movement therealong. Carried on the mast carrier and either connected to or connectable to the mast, is a CT injector.

In another aspect the present invention provides a CT carrier having first and second sides and a reel assembly comprising a spool of CT rotatably mounted thereon and a drive system for rotating the spool of CT. The spool has first and second, spaced rims which are near the first and second sides, respectively. The spacing between the rims provide a CT winding core which makes maximum utilization of the width of the carrier vis-a-vis being able to wind more CT on the spool. There is also a drive assembly for rotating the spool.

BRIEF DESCRIPTION OF THE DRAWINGS

FIG. 3 is a side, elevational view showing the CT carrier married to the mast carrier and in a position for transport over non-governmental regulated highways or the like.

DETAILED DESCRIPTION OF PREFERRED EMBODIMENTS

Figure 1:
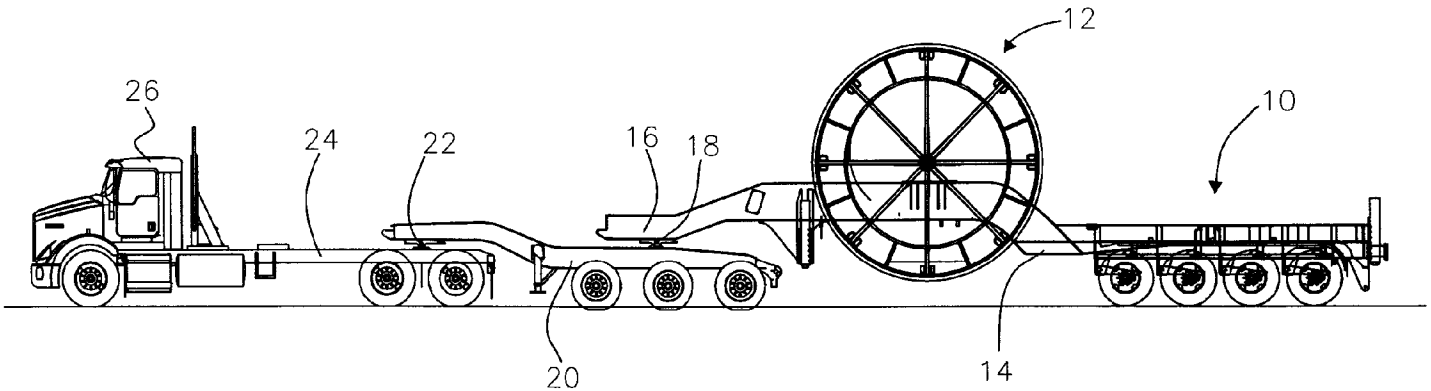
FIG. 1 is a side, elevational view showing the CT carrier attached to a tractor for transport.

Turning first to FIG. 1, there is shown a CT carrier, shown generally as 10, having rotatably journaled thereon a reel 12 of CT. As seen, CT carrier 10 is of the wheeled design and comprises a platform 14 on a suitable frame (not shown) and having a tongue 16 which via a fifth wheel 18 is selectively, releasably and rotatably connected to a trailer 20 of the wheeled variety, trailer 20 being connected via a second fifth wheel 22 on the bed 24 of a tractor 26. Thus, the CT carrier 10 carrying reel 12 of CT can be moved down the highway or from site to site in a drilling or well servicing area.

Figure 2:
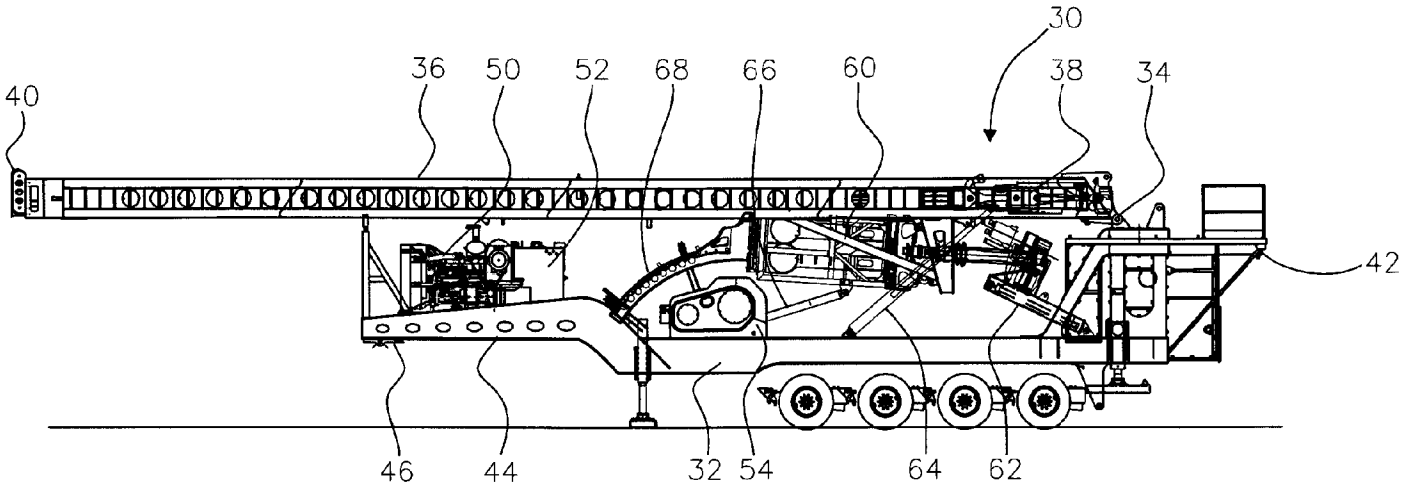
FIG. 2 is a side, elevational view showing the mast carrier with the mast in a position for transport.

FIG. 2 depicts a mast carrier, shown generally as 30 comprising a substructure 32. As shown, carrier 30 is also of the wheeled variety. Pivotally secured to carrier 30 as at 34 is a mast 36 in which is mounted a top drive shown as 38. As is well known to those skilled in the art, top drive 38 is connected to a crown block 40, suitable cables extending from crown block 40 to top drive 38. Mast carrier 30 also includes a working platform 42 which can include a rotary table.

Figure 3:
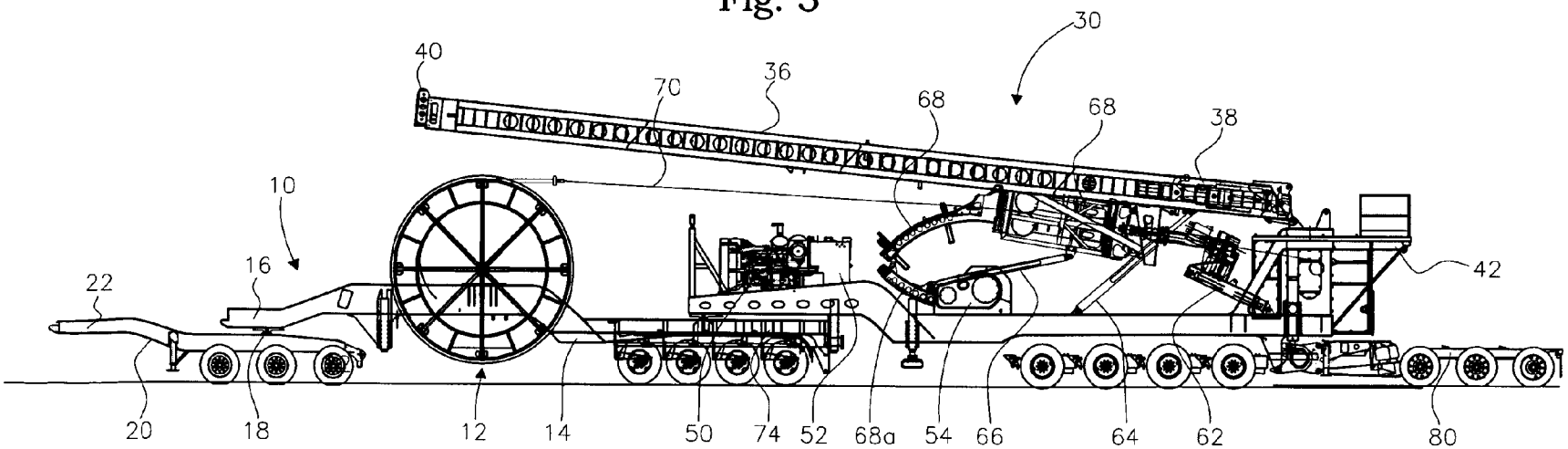
Figure 4:
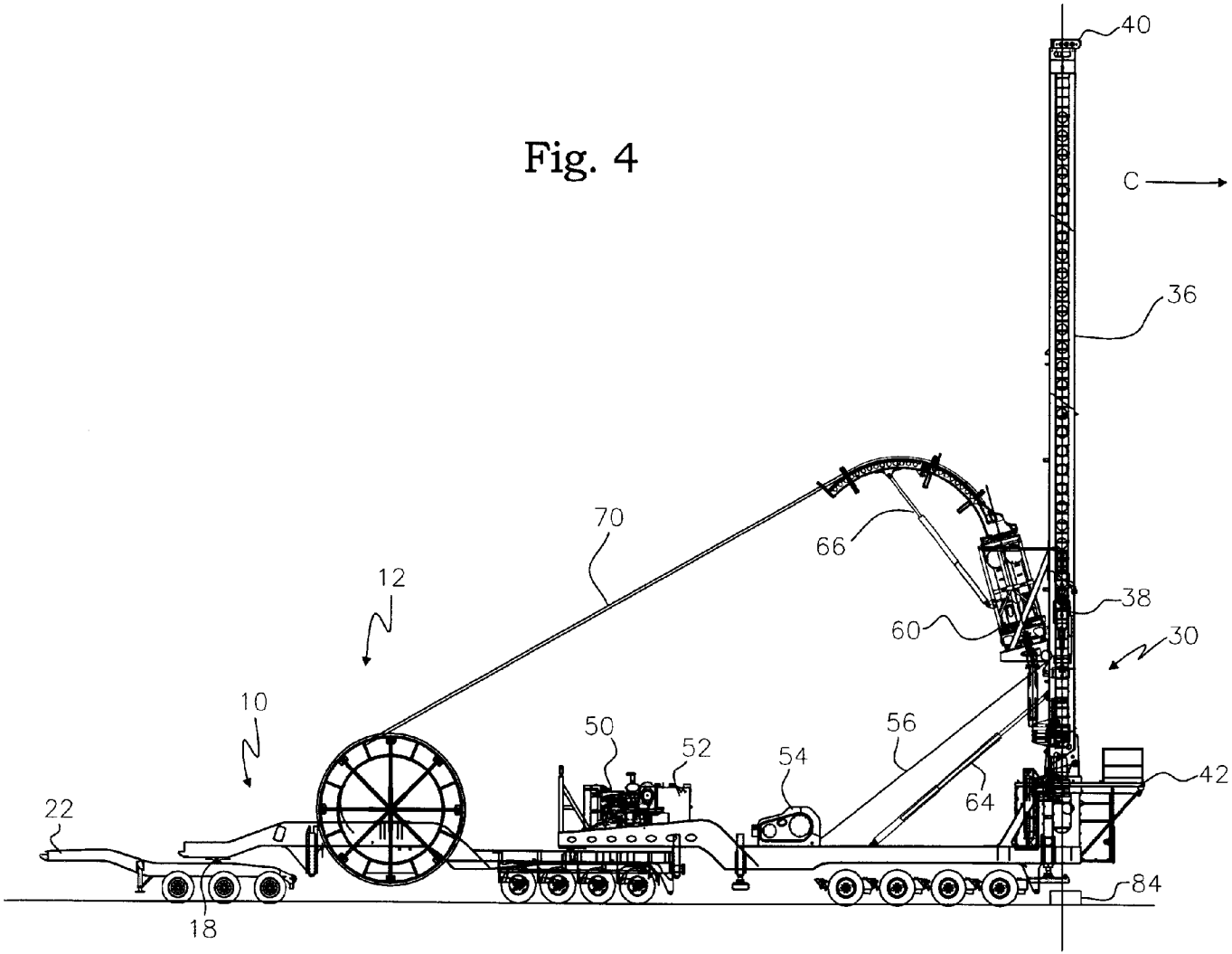
FIG. 4 is a side, elevational view showing the CT rig married to the mast rig and the mast in an erected position to perform jointed pipe operations with the top drive carried by the mast.
Figure 5:
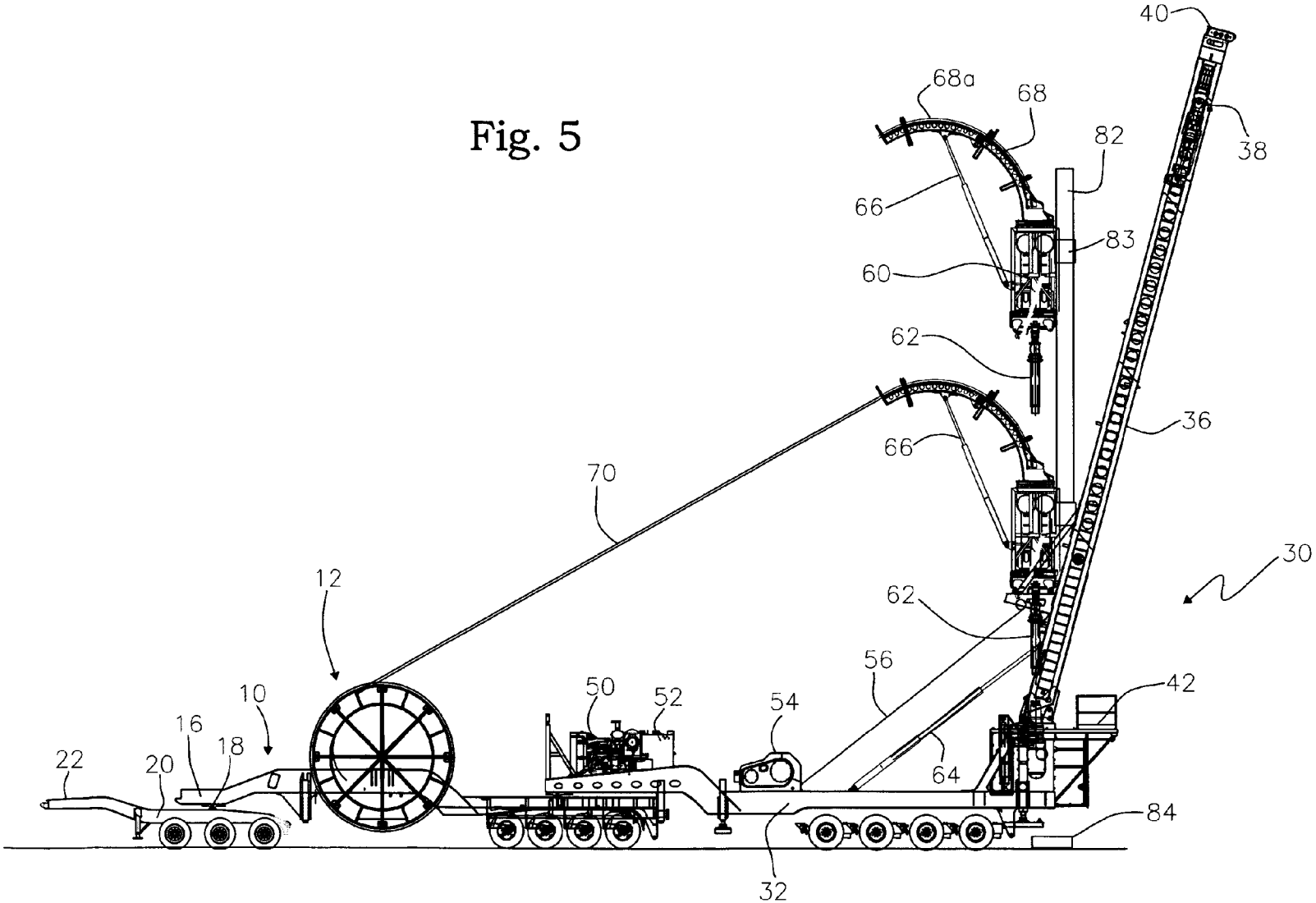
FIG. 5 is a side, elevational view of the CT carrier and the mast carrier married to one another and showing a CT injector movably connected to a slide supported on the mast.

As seen in FIGS. 3 and 4, mast 36 is movable from a lowered or transport position shown in FIG. 2 to a position transverse to the horizontal and with particular reference to FIG. 4 to a generally vertical position. Mast carrier 30 also includes a tongue 44 which has a fifth wheel connector 46 whereby mast carrier 30 can be connected to a tractor or the like for transport or as shown in FIG. 5 to CT carrier 10. It will be understood that mast carrier 30 and CT carrier could be of the self-propelled variety. Mast carrier 30 is also provided with a support 48 upon which mast 36 rests when in transport, i.e., in the mode shown in FIG. 2. Also resting on the substructure 32 of mast carrier 30 is an engine 50 and a hydraulic tank 52 for the storage of hydraulic fluid used in operating the various hydraulic components of the system, e.g., motors, pistons/cylinder arrangements, etc. As is well known, most of the components of the system of the present invention may be operated hydraulically, electrically, or in some cases pneumatically. Also mounted on substructure 32 is a draw works 54 which as seen in FIG. 4 has cables 56 which run through a sheave assembly (not shown) to crown block 40.

Attached to mast 36 is a CT injector 60 from the bottom of which extends an articulated lubricator 62. Secured between mast 36 and substructure 32 of carrier 30 is a piston/cylinder combination 64 which is used to raise mast 36. A piston/cylinder combination 66 is also connected between CT injector 60 and a portion 68*a* of guide or gooseneck 68 as best seen in FIG. 3.

Turning now to FIG. 3, mast rig 30 is shown with mast 36 having been raised from the position shown in FIG. 2 to a slightly elevated position using cylinder 64 of which there are two, only one being shown. Also, as can be seen, piston/cylinder combination 66 has been partially extended as a commencement of forcing portion 68*a* of guide 68 into a complete arc as shown in FIG. 4. As can also be seen, CT 70 has been unreeled from reel 12 and stabbed into CT injector 60. It will also be observed that rig carrier 30 and CT carrier 10 are married in the embodiment shown in FIG. 3 being connected by fifth wheel connector or other suitable connection to CT carrier 10 allowing pivotal movement between rig carrier 30 and CT carrier 10. Thus it will be seen that at least in one embodiment, CT carrier 10 and rig carrier 30 can be selectively, releasably connected to one another and the combined carriers pulled as a single unit which would most likely occur if the system was being moved from one drilling or servicing site to another drilling or servicing site and did not have to traverse governmental regulated highways. As can also be seen, when this is occurring, a booster trailer 80 would be connected by a fifth wheel connection or some other suitable connection to the rear of rig carrier 30.

Turning now to FIG. 4, the system is shown with mast 36 erected to a general vertical position. As can be seen, CT injector 60 is attached to mast 36 such that an axis running through CT injector 60 and an axis passing through top drive 38 are at an angle to one another. In the position shown in FIG. 4, CT injector 60 would be inoperative since CT issuing therefrom would not be in line with wellhead 84 of the wellbore below but not shown. Rather, in the configuration of FIG. 4, top drive 38 could perform jointed pipe operations since the axis of top drive 38 is in line with wellhead 84. It will be appreciated that if mast 36 is now moved in the direction of arrow C, mast 36 being pivotally secured to substructure 32, CT injector can be brought to a position where the axis therethrough is substantially coincident with the axis of wellhead 84. Accordingly, CT issuing from CT injector 60 will be in line with wellhead 84 and can be injected into the wellbore therebelow.

Turning now to FIG. 5, there is shown a variation of the system of the present invention wherein CT injector 60 is slidably fixed to a slide 82 which in turn is affixed to the mast 36 at the juncture of the mast and the substructure 32. It will be understood that slide 82 and mast 36 will always be at an angle to one another and, accordingly, to position CT injector over wellhead 84 mast 36 has to be tilted as shown. When it is desired to perform top drive operations with top drive 38, mast 36 would then be moved to a substantially vertical position meaning that slide 82 would then be at an angle to the horizontal much like mast 36 is as shown in FIG. 5.

As best seen in FIG. 5, slide 82 permits CT injector 60 to be moved axially toward and away from wellhead 84. CT injector 60 can be connected to slide 82 by a collar 83 or the like which can be pinned or otherwise positioned at desired locations along the length of slide 82. In the position shown in FIG. 5, CT injector 60 is in the operative position, i.e., lubricator 62 can be connected if necessary to wellhead 84 in the well known manner and CT 70 injected through wellhead 84 into the wellbore there below. It will also be observed that in the position shown in FIG. 5, top drive 38 is moved upwardly in mast 36 towards crown 40 so as to not interfere with the movement of CT injector 60 along slide 82. Thus, as shown in FIG. 5, CT injector is shown in two positions, the lowermost being when CT is being injected through wellhead 84 into the wellbore therebelow.

Figure 6:
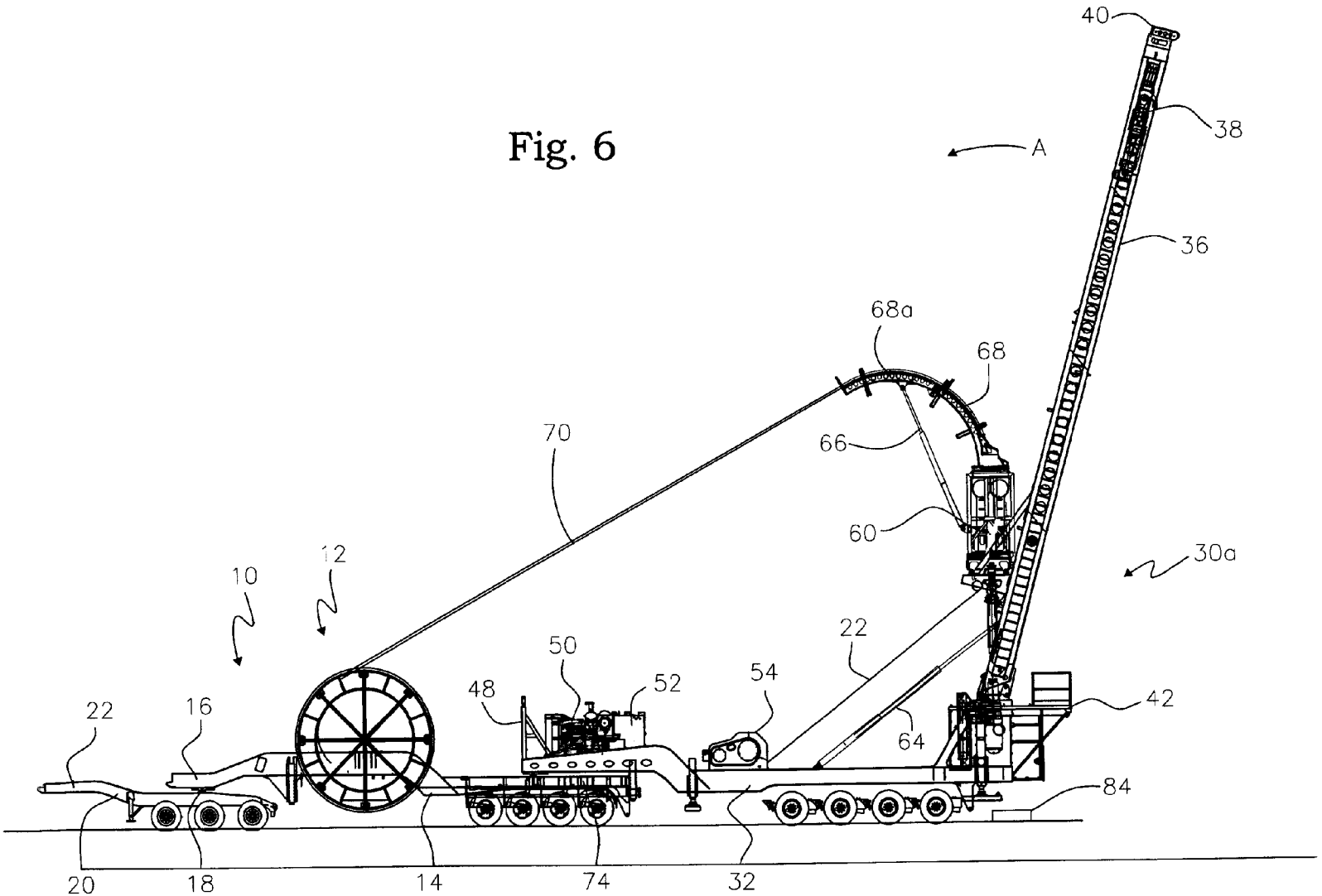
FIG. 6 is a side, elevational view showing a CT carrier married to the mast carrier with the mast moved laterally off vertical whereby the CT injector connected thereto can be positioned over a wellbore/wellhead with the CT issuing therefrom in line with the wellbore.

FIG. 6 depicts the embodiment shown in FIG. 4 wherein CT injector 60 is hung off of the side of the mast 36 such that top drive 38 is at an angle to wellhead 84 whereas CT injector 60 is substantially in line with the wellhead 84 meaning that CT 70 issuing therefrom is generally in line with wellhead 84 above the wellbore. In the embodiment shown in FIG. 6, the axes of top drive 38 in CT injector 60 are always at an angle to one another. However, in the configuration shown in FIG. 6, CT injector 60 is in line with wellbore 84 meaning that top drive 38 is in an inoperative position since the axis of top drive 38 is at an angle to wellhead 84. It will be appreciated that by tilting mast 36 in the direction of arrow A, the axis of top drive 38 can be made coincident with wellhead 84 in which event top drive 38 can conduct jointed pipe operations and CT injector 60 will be in an inoperative position since it will now be off-axis with respect to wellhead 84.

Mechanisms for supporting CT injector 60 off of mast 36 in the embodiments shown in FIGS. 4 and 6 are disclosed in one or more of the above identified cross referenced applications. Suffice to say that numerous techniques can be employed to suspend CT injector 60 off of mast 36 in the configuration shown in FIGS. 4 and 6. In this regard, CT injector 60 can be affixed to mast 36 at all times or can be selectively latched onto mast 36 as desired. In the latter case, CT injector 60 would rest on substructure 32 of mast carrier 30*a* and, when mast 36 was moved to a position such as shown in FIG. 2, could then be latched onto mast 36.

Figure 7:
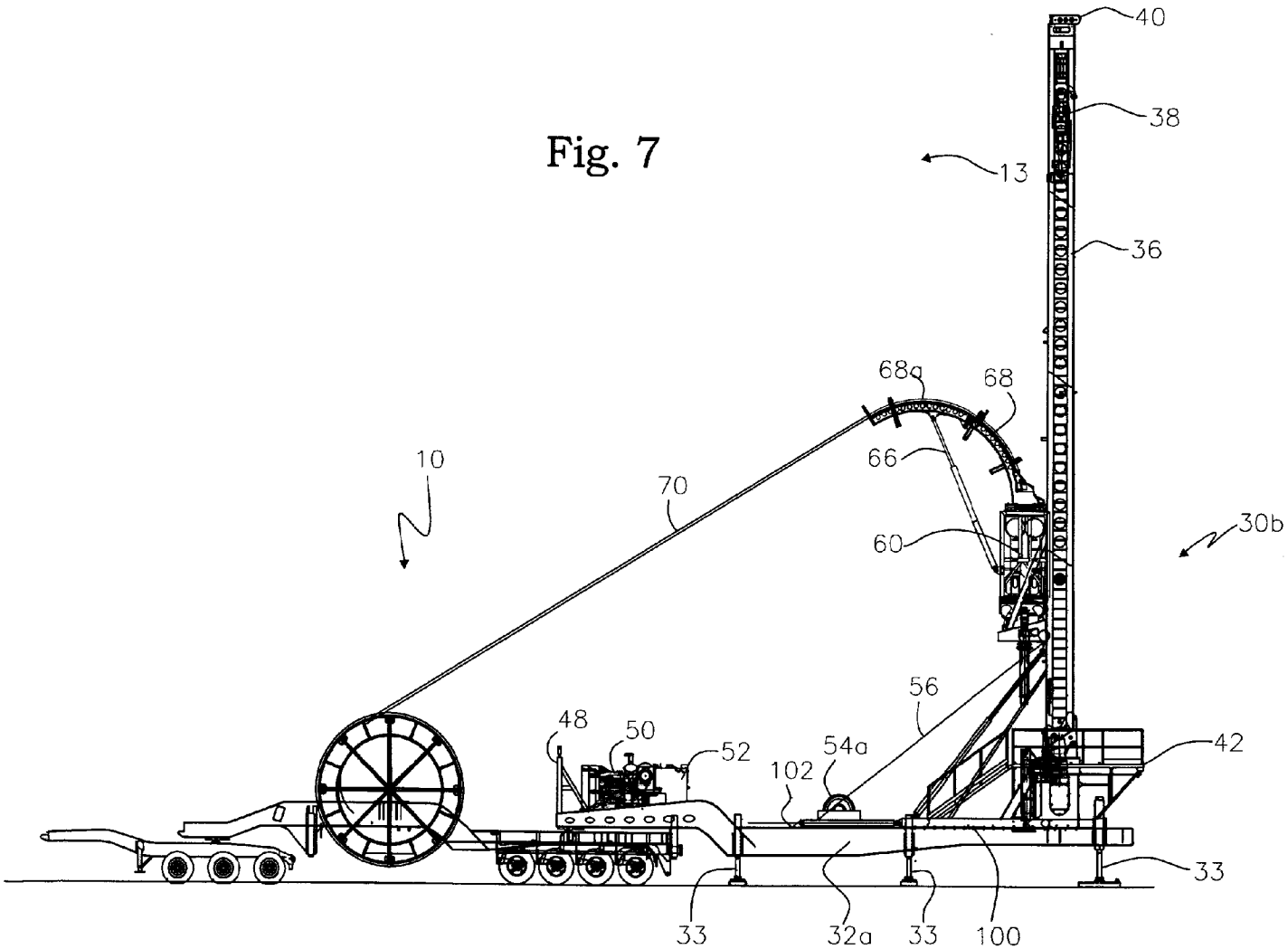
FIG. 7 is a side, elevational view of another embodiment of the present invention showing a CT carrier married to a mast carrier wherein the mast carrier is of the skid design.

Referring now to FIG. 7 there is shown another embodiment of the present invention. In the embodiment shown in FIG. 7, CT carrier 10 is substantially as shown above with respect to the other embodiments; however, rig carrier 30*b* differs in that rather than being a wheeled carrier, it is in a skid form such that substructure 32*a* can be pulled along the ground if necessary once outriggers 33 have been raised. Alternatively, substructure 32*a*, once outriggers 33 have been raised, can be pulled onto a wheeled trailer or the like for transport. In the embodiment shown in FIG. 7, substructure 32*a* supports a sliding platform 100 which can be moved horizontally using a piston/cylinder combination 102. Thus, CT injector 60 can be attached to mast 36 such that at all times both the axes of CT injector 60 and top drive 38 at all times remain vertical and essentially parallel to one another. Accordingly, by horizontal movement of the platform 100 via the action of piston/cylinder combination 102, either CT injector 60 or top drive 38 can be selectively positioned over the wellhead, i.e., such that either the axis of top drive 38 is coincident with the wellhead or the axis of CT 60 is coincident with the wellhead.

Figure 8:
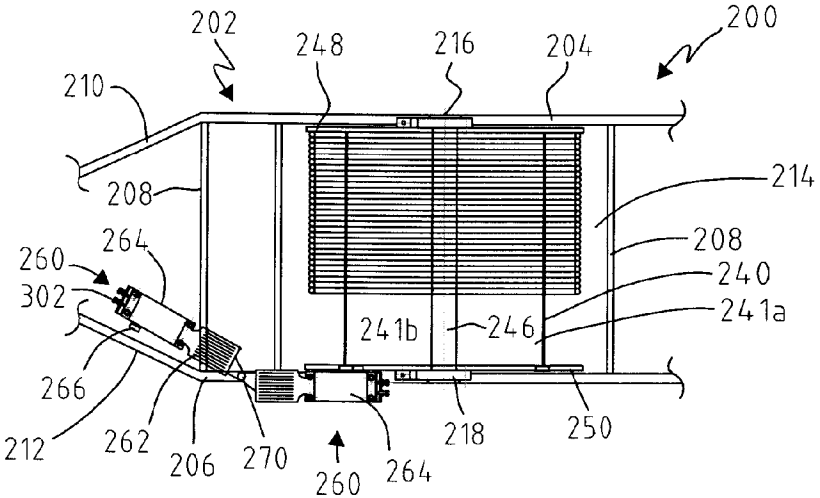
FIG. 8 is a top plan view of one embodiment of one embodiment of a CT carrier of the present invention.
Figure 9:
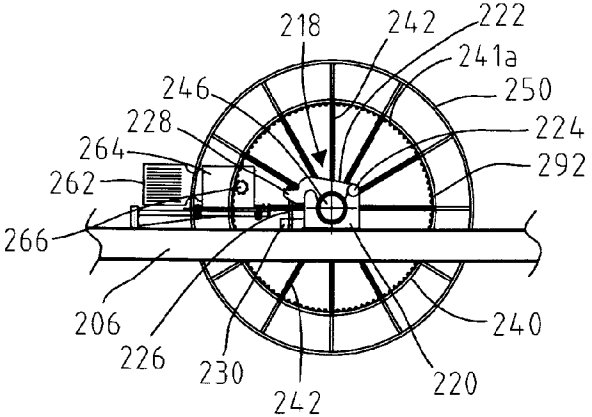
FIG. 9 is a side, elevational view of a portion of the CT carrier shown in FIG. 8.
Figure 10:
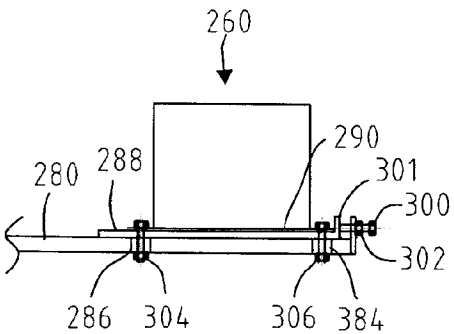
FIG. 10 is a side, elevational view of a mechanism for adjusting the position of the drive assembly used in the CT carrier shown in FIGS. 8 and 9.

Referring now to FIGS. 8, 9 and 10 there is shown as embodiment of a CT carrier which permits a maximum length winding core for CT around the drum of the reel assembly. Referring first then to FIG. 8, the carrier, shown generally as 200, can be of the wheeled variety as discussed above with respect to the carrier shown in FIGS. 1-7. In this regard it should be noted that both the CT carrier and the rig carrier can be wheeled, self-propelled, in the form of a skid or any other form of support which can hold the various components, e.g., the reel of CT, the mast, etc. Returning then to FIG. 8, carrier 200 has a frame shown generally as 202 comprising first and second, side frame members 204 and 206 connected by cross braces 208. First and second angled members 210 and 212 can form a tongue (not shown) whereby carrier 200 can be pulled by a tractor or the like. Mounted on carrier 200 is a reel assembly shown generally as 214. Reel assembly 214 comprises first and second pillow blocks 216 and 218 which are attached to side frame members 204 and 206, respectively. Pillow blocks 216 and 218 are substantially the same. Accordingly for simplicity, only the structure of pillow block 218 will be described. As seen in FIG. 9, pillow block shown generally as 218 is comprised of two, hinged sections, a lower section 220 and an upper section 222, the sections being hingedly secured to one another by pivot pin 224. It will be appreciated that when section 222 is opened, the reel assembly 214 can be removed from carrier 208. In any event, in the closed position shown in FIG. 9, section 222 engages section 220, section 222 being held firmly against section 220 by means of a threaded pin 226 received through a tongue portion 228 of section 222 and threadedly received in a block 230 affixed to frame member 206. Reel assembly 214 further includes a cylindrical drum 240 which is connected by a series of spokes 242 to an axle 246, drum 240 and axle 246 being generally concentric with respect to one another. As can be seen, the inner surface 241*a* of drum 240, forms an annulus 241*b* between axle 246 and surface 241*a*. Axle 246, as will be appreciated by those skilled in the art, is rotatably journaled in pillow boxes 216 and 218. First and second spaced rims 248 and 250 are secured to or near the opposite ends of drum 240 and form a winding core determined by the spacing between the rims 248 and 250. As best seen in FIG. 8, because the rims 248 and 250 are near the side frame members 204 and 206, the winding core effectively extends for almost the full width of carrier 200. This is to be contrasted with prior art CT carriers wherein the winding core was substantially less because the rims on the reel were not positioned near the respective sides of the carrier. Rather, although one of the rims could be positioned adjacent one side of the carrier, the other rim was substantially inboard, e.g., up to 3 feet, to accommodate the drive mechanism to rotate the spool.

Mounted on side frame member 206 is a drive assembly shown generally as 260. Drive assembly 260 comprises a motor 262 and a gear box 264. A spur gear 266 is driven by internal gearing in gearbox 264 which in turn is driven by motor 262. Drive assembly 260 is mounted on an arm 280 which is pivotally secured to frame member 206 by a pivot pin 270. Thus, as can be seen, drive assembly 260 can be pivoted from a first position wherein it is fully confined within the frame 202 of carrier 200 to a second position where it extends outside of frame 202 generally aligned with side frame member 206.

Arm 280 is provided with elongated slots 284 and 286. Supported on arm 280 is a slide plate 288 upon which drive assembly 260 rests, drive assembly 260 as shown in FIG. 10 having a flange 290.

When drive assembly 260 is pivoted to the second position described above, the spur gear 266 will be moved into the annulus 241 between axle 246 and the inside surface 241*a* of drum 240. As best seen with reference to FIG. 9, its inner surface of rim 250 or for that matter the inner surface 241*a* of drum 240 has a series of circumferentially disposed teeth 292. Teeth 292 are of a size and shape that mesh with the teeth of gear 266. By adjusting drive assembly 260 such that gear 266 engages teeth 292, it will be seen that as gear 266 is rotated via gearbox 264, drum 240 will also be caused to rotate.

To ensure proper engagement between gear 266 and teeth 292, the drive assembly 260 is adjustable in a direction generally lengthwise of side frame member 206. Again referring to FIG. 10, it can be seen that once arm 280 has been pivoted to the position where gear 266 is received in annulus 241*b*, slide plate 288 can be moved longitudinally relative to side frame member 206 by adjustment screws 300 having locking nuts 302, the screws engaging a flange 301 formed on slide plate 288. Once gear 266 is properly engaged with teeth 292, nut and bolt assemblies 304 and 306 can be tightened to ensure that the drive assembly 260 does not move and gear 266 remains in driving contact with teeth 292.

Figure 11:
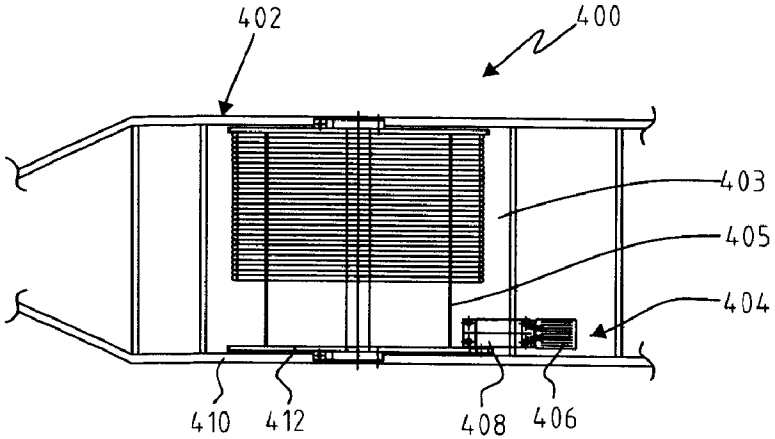
FIG. 11 is a top plan view of another embodiment of the CT carrier of the present invention.
Figure 12:
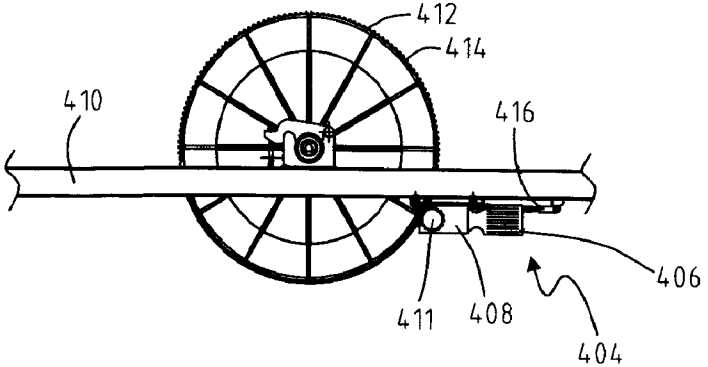
FIG. 12 is a side elevational view of the CT carrier shown in FIG. 11.

Turning now to FIG. 11, there is shown another way in which maximum winding core length can be achieved by a CT carrier. CT carrier, shown generally as 400 like CT carrier 200 has a frame shown generally as 402 generally constructed in the same manner as frame 202. Additionally, the reel assembly, shown generally as 403, in terms of how it is mounted on the frame is essentially the same as the embodiment shown in FIGS. 8-10. Accordingly, for the sake of simplicity, the description of the reel assembly 403 will be dispensed with except as is necessary to explain the operation of the embodiment shown in FIGS. 11-13. A drive assembly shown generally as 404 comprising a motor 406 and a gearbox 408 is mounted to the underside of a side frame member 410 of frame 402. As seen in FIG. 12, gearbox 408 drives a spur gear 411 by internal gearing, well known to those skilled in the art, in gearbox 408. Rim 412 of the spool of reel assembly 403 is provided on its outer periphery with a series of teeth 414 which mesh with the teeth on spur gear 411. Thus it can be seen that when spur gear 411 engages teeth 414 on the periphery of rim 412, rim 412 and hence the drum 405 of the reel assembly 403 can be rotated in either direction depending upon the direction of rotation of spur gear 411.

Figure 13:
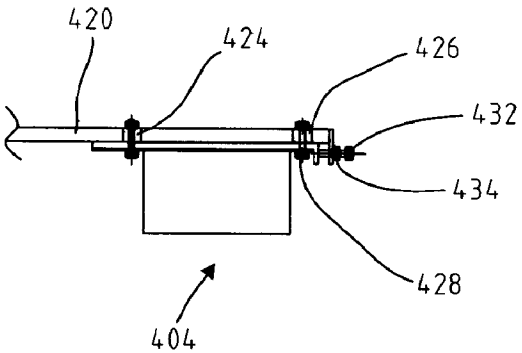
FIG. 13 is a side, elevational view of a mechanism for adjusting the position of the drive assembly of the embodiment shown in FIGS. 11 and 12.

To ensure proper meshing between spur gear 411 and teeth 414, drive assembly 404, like drive assembly 260 shown in FIGS. 8-10 is adjustable. As shown in FIG. 12, a piston/cylinder assembly 416 connected between side frame member 410 and drive assembly 404 and can be used to move drive assembly 404 in a direction generally parallel to side frame member 410. Once gear 411 is properly engaged with teeth 414, drive assembly can be held in place by piston/cylinder combination 416. Alternatively, essentially the same adjustment mechanism used with respect to the embodiment shown in FIGS. 8-10 can be used as shown in FIG. 13. Referring then again to FIG. 13, there is a plate 420 secured to the underside of frame member 410 upon which is carried a slide plate 422. Plate 420 has spaced slots 424 and 426. Extending through holes in the slide plate 422 are nut and bolt assemblies 428 and 430 which also extend through slots 426 and 424, respectively. Thus, once the spur gear 411 is properly engaged with teeth 414, nut and bolt assemblies 428 and 430 can be tightened to maintain the position of drive assembly 404 relative to the rim 412. As also is shown in FIG. 13, rather than using a piston/cylinder combination such as 416 to position the drive assembly 404, adjustment screws 432 having locking nuts 434 could be used in the same manner as described above with respect to the embodiments shown in FIGS. 8-10.

Figure 14:
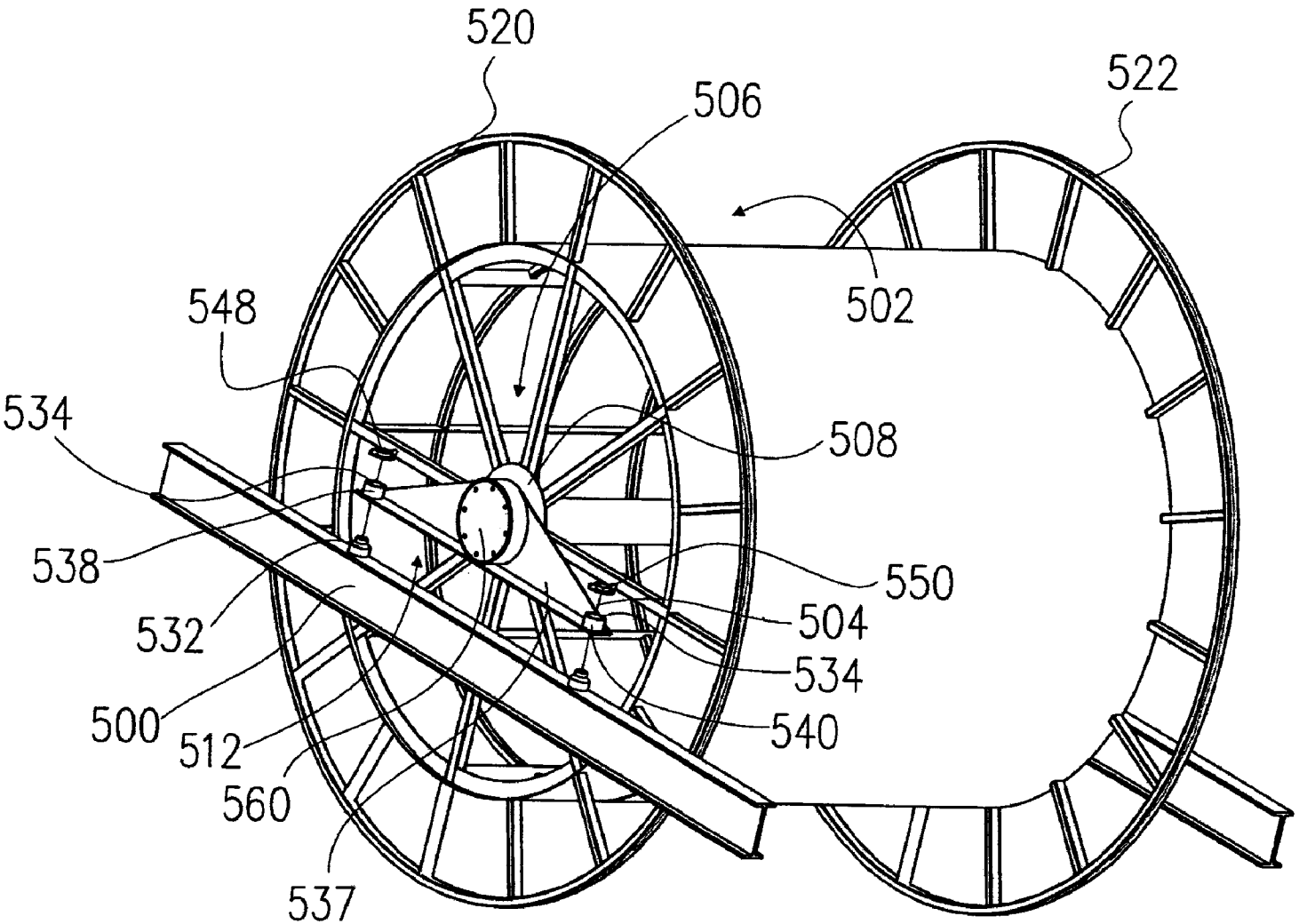
FIG. 14 is a fragmentary, perspective view of another embodiment of the CT carrier of the present invention.

Referring now to FIG. 14, there is shown yet another way of achieving maximum winding core length for CT. For purposes of simplicity, only a portion of the frame, frame member 500, is shown together with the spool 502. Spool 502 has an axle 504 one end of which is received in a hydraulic motor shown as 506 and having a housing 508. Axle 504 is connected to an internal rotatable shaft in hydraulic 506. Hydraulic motors of this type are well known to those skilled in the art. Although not shown, it will be appreciated that inlet and outlet lines for hydraulic fluid from a suitable source would be connected to hydraulic motor 506. The housing 508 of hydraulic motor is stationary and is connected to a mounting bracket 512 which in turn is removably affixed to frame member 500. It will be understood that there are two mounting brackets 512, one on each side of the carrier the mounting bracket on the opposite side from bracket 512 serving only as a journal with a bearing pack for axle 504. There are a pair of tapered posts 530 and 532 secured to side frame member 500. The tapered posts, as seen are threaded. Bracket 512 is provided with spaced sockets 534 and 536 defined by tubes 538 and 540 secured to a flange 537 of bracket 512. In the exploded view of FIG. 14, it can be seen that sockets 534 and 536 are in register with the tapered posts 532 and 530, respectively. Thus, bracket 512 can be positioned on post 532 and 530 and secured thereto by means of wing nuts 548 and 550. It will also be seen and as is conventional on CT reel assemblies, there is a brake 560. As in the case of the embodiments shown in FIGS. 8-13, the embodiment shown in FIG. 14 maximizes winding area for the CT since the drive mechanism for the reel assembly does not take up any of the lateral length of the carrier, i.e., the length from side to side of the carrier since the drive motor 506 is internal to the spool 502. Thus, as seen, rims 520 and 522 are positioned near the respective sides of the carrier maximizing the winding core length for the CT.

In the foregoing description, and particularly with reference to the embodiments shown in FIGS. 8-15, the word "near" or "close" has been used, e.g., in describing the position of the rims relative to the sides of the carrier. It is not intended that the words "near" or "close" be limited to the rims being flush with the respective sides of the carrier or, for that matter, even within an inch or two of the respective sides of the trailer. Indeed, the rims could be just inside the side frame members as seen in the embodiment of FIG. 14 and still be considered "close" to the sides of the carrier. Thus, consistent with the goal of these embodiments of the invention which is to maximize the winding core length between the rims so as to get the maximum amount of coil on the spool and hence the carrier, the words "near" or "close" are intended to encompass a configuration where the rims could still be slightly spaced from the sides of the carrier, e.g., about at the sides of the carrier. Ideally, particularly to achieve maximum winding core length, the rims will be as near or close to the sides of the carrier as is practical. It will also be understood that for purposes of not violating governmental regulations regarding the width of the carrier which can traverse regulated highways, roadways and the like, both the width of the carrier and/or the width of the reel assembly will be such as to meet such governmental regulations regarding the width of loads traversing regulated highways.

Figure 15:
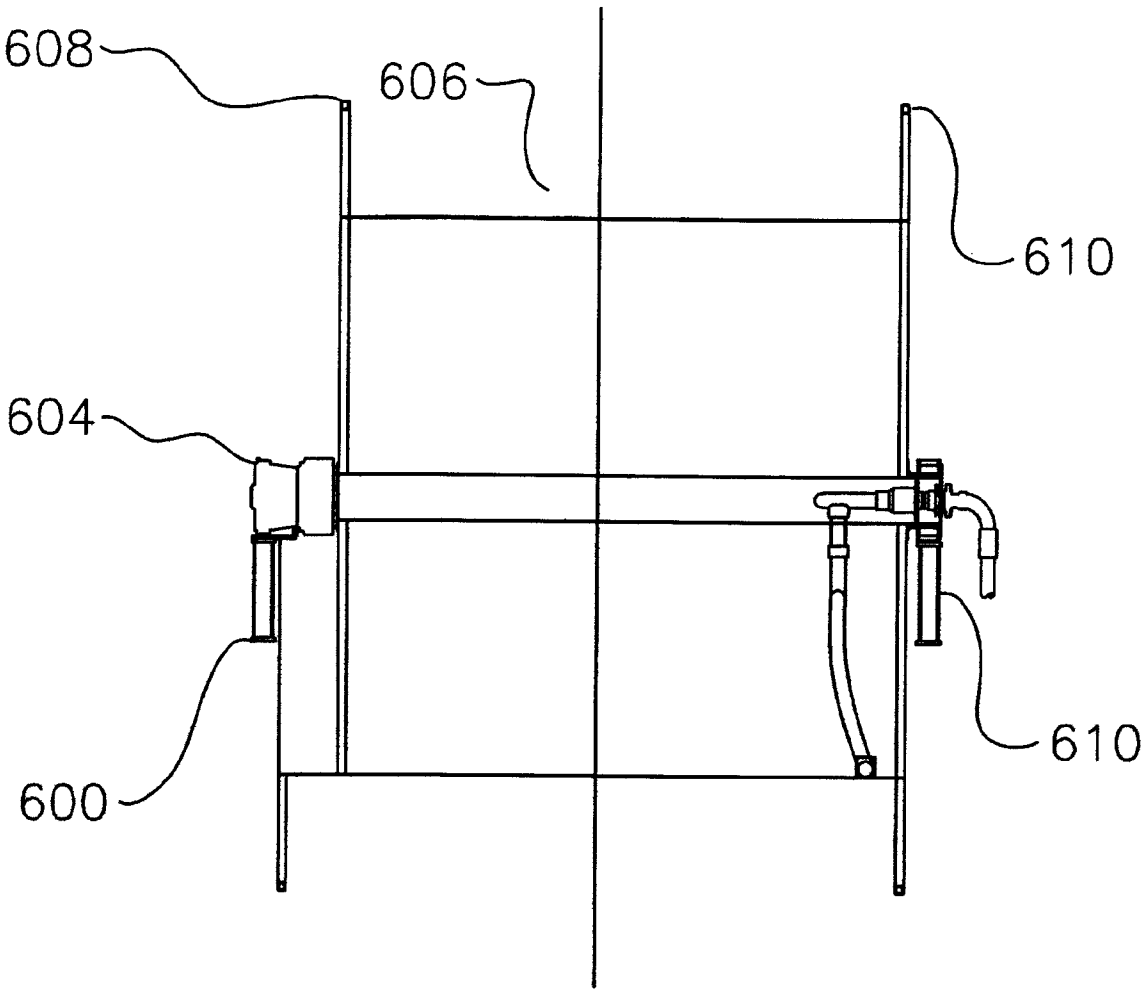
FIG. 15 is a fragmentary, top plan view of a CT carrier showing a way to increase winding core length.

Turning now to FIG. 15, there is shown another embodiment of the present invention wherein although the winding core length is not maximized as in the embodiments discussed in FIGS. 8-14, the winding core length is increased over prior art assemblies. In prior art CT carriers, the spool of CT is generally located midway between the sides of the carrier, each rim being two feet or more from the side of the carrier closest to the rim. Typically, the drive assembly is located between the side of the carrier and one end of the spool while hydraulic systems or other equipment is located between the other side of the carrier and the other end of the spool. FIG. 15 shows a manner in which these typical prior art systems can be modified to increase the winding core length albeit that it is not maximized as discussed above with respect to the embodiments shown in FIGS. 8-14. The carrier of the embodiment of FIG. 15 comprises side frame members 600 and 602. The drive assembly shown generally as 604 is located between side frame member 600 and the spool shown generally as 606. As can be seen, one rim 608 of the spool 606 is displaced substantially inboard from side frame member 600. However, the other rim 610 is near side frame member 602. The embodiment shown in FIG. 15 can be achieved simply by taking a prior art system, leaving the drive assembly where it typically is positioned on the carrier, removing any equipment that would normally be positioned between rim 610 and side frame member 602 and increasing the length of the spool. Thus, by this technique one can achieve an increased winding core length of perhaps two feet or more. Thus, the embodiment of FIG. 15 envisions leaving or positioning a drive assembly between one side of the carrier and the spool such that one rim is laterally displaced from one side frame member and increasing the spool length such that the other rim is near the opposite side frame member of the carrier.

The foregoing description and examples illustrate selected embodiments of the present invention. In light thereof, variations and modifications will be suggested to one skilled in the art, all of which are in the spirit and purview of this invention.

What is claimed is:

1. A system for conducting earth borehole operations comprising:

a mast carrier;

a mast mounted on said mast carrier and movable between a lowered position for transport and a position transverse to the horizontal;

a top drive mounted on said mast, for longitudinal movement along said mast;

a coiled tubing (CT) injector on said mast carrier; and an elongate, vertical slide attached to said mast carrier, said CT injector being selectively attachable to said mast or said slide, said slide and said mast being angularly movable relative to one another whereby when one of said slide and said mast is axially aligned with a borehole, the other of said slide and said mast is out of alignment with said borehole.

2. The system of claim 1, wherein when said CT injector is attached to said mast to insert CT into the borehole, said CT injector has an injector axis offset from the axis of the top drive and substantially aligned with the axis of the borehole when the mast is in a position to perform CT operations.

3. The system of claim 1, further comprising a CT carrier, separate from said mast carrier, a reel of CT being carried by said CT carrier.

4. The system of claim 3, wherein said CT carrier and said mast carrier are wheeled carriers.

5. The system of claim 4, wherein said CT carrier and said mast carrier are selectively, pivotally securable to one another whereby said CT carrier can be positioned at a desired angle relative to said mast carrier.

6. The system of claim 1, wherein said CT injector is attached to said mast and said mast is pivotal relative to the mast carrier between a first position wherein said top drive is generally axially aligned with the borehole for insertion and/or removal of threaded tubulars and a second position wherein said CT injector is generally aligned with the borehole for insertion and/or removal of CT.

7. The system of claim 1, wherein said mast is attached to a sliding platform mounted on said mast carrier, said platform being movable from a first position wherein said top drive is in line with the borehole and a second position wherein said CT injector is in line with said borehole.

8. The system of claim 1, wherein said mast includes a substructure portion, said CT injector being selectively movable from a position on said substructure portion detached from said mast to a position attached to one of said mast or said slide.

9. The system of claim 1, wherein said CT injector is attached to said slide for sliding movement therealong.

10. A system for conducting earth borehole operations comprising:

a mast carrier;

a mast mounted on said mast carrier and movable between a lowered position for transport and a position transverse to the horizontal;

a top drive mounted on said mast, for longitudinal movement along said mast;

a coiled tubing (CT) injector on said mast carrier; and a vertical slide attached to said mast carrier, said CT injector being selectively attachable to said mast or said slide, wherein when said CT injector is attached to said mast to insert CT into a borehole, said CT injector has an injector axis offset from the axis of the top drive and substantially aligned with the axis of the borehole when the mast is in a position to perform CT operations.

11. The system of claim 10, further comprising a CT carrier, separate from said mast carrier, a reel of CT being carried by said CT carrier.

12. The system of claim 11, wherein said CT carrier and said mast carrier are wheeled carriers.

13. The system of claim 10, wherein said CT injector is attached to said mast and said mast is pivotal relative to the mast carrier between a first position wherein said top drive is generally axially aligned with the borehole for insertion and/or removal of threaded tubulars and a second position wherein said CT injector is generally aligned with the borehole for insertion and/or removal of CT.

14. The system of claim 10, wherein said mast includes a substructure portion, said CT injector being selectively movable from a position on said substructure portion detached from said mast to a position attached to one of said mast or said slide.

15. The system of claim 10, wherein said CT injector is attached to said slide for sliding movement therealong.

16. A system for conducting earth borehole operations comprising:

a mast carrier;

a mast mounted on said mast carrier and movable between a lowered position for transport and a position transverse to the horizontal;

a top drive mounted on said mast, for longitudinal movement along said mast;

a coiled tubing (CT) injector on said mast carrier; and a vertical slide attached to said mast carrier, said CT injector being selectively attachable to said mast or said slide, wherein said CT injector is attached to said mast and said mast is pivotal relative to the mast carrier between a first position wherein said top drive is generally axially aligned with a borehole for insertion and/or removal of threaded tubulars and a second position wherein said CT injector is generally aligned with the borehole for insertion and/or removal of CT.

17. The system of claim 16, wherein when said CT injector is attached to said mast to insert CT into a wellbore, said CT injector has an injector axis offset from the axis of the top drive and substantially aligned with the axis of the borehole when the mast is in a position to perform CT operations.

18. The system of claim 16, further comprising a CT carrier, separate from said mast carrier, a reel of CT being carried by said CT carrier.

19. The system of claim 18, wherein said CT carrier and said mast carrier are wheeled carriers.

20. The system of claim 16, wherein said mast includes a substructure portion, said CT injector being selectively movable from a position on said substructure portion detached from said mast to a position attached to one of said mast or said slide.

21. The system of claim 16, wherein said CT injector is attached to said slide for sliding movement therealong.

22. A system for conducting earth borehole operations comprising:

a mast carrier;

a mast mounted on said mast carrier and movable between a lowered position for transport and a position transverse to the horizontal;

a top drive mounted on said mast, for longitudinal movement along said mast;

a coiled tubing (CT) injector on said mast carrier; and a vertical slide attached to said mast carrier, said CT injector being selectively attachable to said mast or said slide, wherein said mast is attached to a sliding platform mounted on said mast carrier, said platform being movable from a first position wherein said top drive is in line with a borehole and a second position wherein said CT injector is in line with said wellbore.

23. The system of claim 22, wherein when said CT injector is attached to said mast to insert CT into the borehole, said CT injector has an injector axis offset from the axis of the top drive and substantially aligned with the axis of the borehole when the mast is in a position to perform CT operations.

24. The system of claim 22, further comprising a CT carrier, separate from said mast carrier, a reel of CT being carried by said CT carrier.

25. The system of claim 24, wherein said CT carrier and said mast carrier are wheeled carriers.

26. The system of claim 22, wherein said CT injector is attached to said mast and said mast is pivotal relative to the mast carrier between a first position wherein said top drive is generally axially aligned with the borehole for insertion and/or removal of threaded tubulars and a second position wherein said CT injector is generally aligned with the borehole for insertion and/or removal of CT.

27. The system of claim 22, wherein said mast includes a substructure portion, said CT injector being selectively movable from a position on said substructure portion detached from said mast to a position attached to one of said mast or said slide.

28. The system of claim 22, wherein said CT injector is attached to said slide for sliding movement therealong.

* * * * *